US005228831A

United States Patent [19]

Becker

[11] Patent Number: 5,228,831

[45] Date of Patent: Jul. 20, 1993

[54] SHEET METAL CENTRIFUGAL PUMP CASING

[75] Inventor: Karlheinz Becker, Worms, Fed. Rep. of Germany

[73] Assignee: KSB Aktiengesellschaft, Frankenthal, Fed. Rep. of Germany

[21] Appl. No.: 836,299

[22] PCT Filed: Aug. 20, 1990

[86] PCT No.: PCT/EP90/01373

§ 371 Date: Mar. 4, 1992

§ 102(e) Date: Mar. 4, 1992

[87] PCT Pub. No.: WO91/03649

PCT Pub. Date: May 21, 1991

[30] Foreign Application Priority Data

Sep. 7, 1989 [DE] Fed. Rep. of Germany ..... 3929758

[51] Int. Cl.[5] ..... F04D 1/00

[52] U.S. Cl. ..... 415/206; 415/914

[58] Field of Search ..... 415/203, 206, 196, 197, 415/914

[56] References Cited

U.S. PATENT DOCUMENTS

| | | | |
|---|---|---|---|
| 893,113 | 7/1908 | Traylor | 415/206 |
| 1,914,919 | 6/1933 | Heermans | 415/206 |
| 3,647,314 | 3/1972 | Laessig | 415/206 |
| 4,789,301 | 12/1988 | Osborne et al. | 415/206 |
| 4,844,693 | 7/1989 | Grzina | 415/206 |

FOREIGN PATENT DOCUMENTS

| | | | |
|---|---|---|---|
| 569707 | 12/1943 | Fed. Rep. of Germany | 415/206 |
| 3517498 | 11/1986 | Fed. Rep. of Germany . | |
| 2017277 | 5/1970 | France . | |
| 1016563 | 5/1983 | U.S.S.R. . | |
| 1213448 | 11/1970 | United Kingdom | 415/206 |

*Primary Examiner*—John T. Kwon

*Attorney, Agent, or Firm*—Peter K. Kontler

[57] ABSTRACT

A centrifugal pump has a casing which accommodates an impeller for conveying abrasive fluid in a predetermined flow direction. The casing has a peripheral wall which is provided with an outlet opening for the fluid. The upstream side and downstream side of the opening are flanked by wear elements which extend transversely of the flow direction and project into the interior of the casing.

10 Claims, 3 Drawing Sheets

SHEET METAL CENTRIFUGAL PUMP CASING

The invention relates to a centrifugal pump.

Sheet metal centrifugal pump casings have very good strength and, depending upon the material used, high resistance to the most diverse pumped media. A drawback of these casings produced from sheet metal is their low resistance to abrasive constituents in the pumped medium. In contrast to a substantially thicker cast casing, the thin-walled sheet metal casing is more readily damaged under the influence of abrasive constituents.

A sheet metal casing is known from the German Offenlegungsschrift 35 17 498. The outer periphery of the casing has an opening and a discharge branch is fitted in the opening. The so-called spine formed by the discharge branch, which facilitates discharge of the pumped medium from the annular chamber into the discharge branch, can be flush with the annular chamber or can project into the annular chamber. The spine is very susceptible to wear during the pumping of media with abrasive constituents.

For a pump casing of the above type, it is accordingly an object of the invention to develop a solution which guarantees a life equivalent to that of a cast casing during the pumping of media containing abrasive constituents.

This object is achieved by the provision of a pump which comprises a casing having a peripheral wall which surrounds a chamber for a rotor serving a convey a fluid circumferentially of the wall in a predetermined direction. The wall has an outlet opening for the fluid, and the upstream and downstream sides of the opening extend transversely of the direction of fluid flow in the casing. The opening is flanked by at least two projections or shielding elements which extend into the chamber transversely of the direction of fluid flow and are disposed at the upstream and downstream sides of the opening.

The outlet from the annular chamber, where a deflection of the flow into the discharge branch takes place, has been found to be especially susceptible to wear. By means of the solution according to the invention, with which the efficiency remains essentially the same, the flow is deflected to a degree, in the region of the outlet opening, towards the center of the casing to subsequently advance into the discharge branch without damage to the outlet opening. The projection mounted at the trailing edge of the outlet opening acts to a certain extent to conduct the flow into the discharge branch but, at the same time, also acts as a wear part and protects the thin casing wall from damage.

An embodiment of the invention provides for the length of the projections to equal the width of the annular chamber. Depending upon the shape of the outlet opening employed and the width relationships of the annular chamber and the outlet opening, the projections can extend over the entire length or a plurality of parts can be distributed in a staggered arrangement. The abrasive constituents are removed from the marginal zones of the outlet opening by the projections and thereafter freely enter the discharge branch.

For projections which are embossed in the sheet metal casing, linings applied to the projections externally of the casing have the effect that, upon wear of the projections, the casing does not become leaky at this location.

The ratio between the height of the projections and the diameter of the annular chamber preferably between 0.01 and 0.04. Such ratio ensures that a good protective effect is achieved with hardly any, or with only a tolerable, loss in efficiency.

The projection mounted at the trailing edge of the outlet opening can extend into the discharge branch. At this location, which is also referred to as a spine, the projection acts as a wear shield against directly impinging abrasive particles.

According to another embodiment, a plurality of projections are distributed over the periphery of the annular chamber. Although this measure guarantees very good protection for the annular chamber, distinct losses in efficiency occur here.

Figure 1:
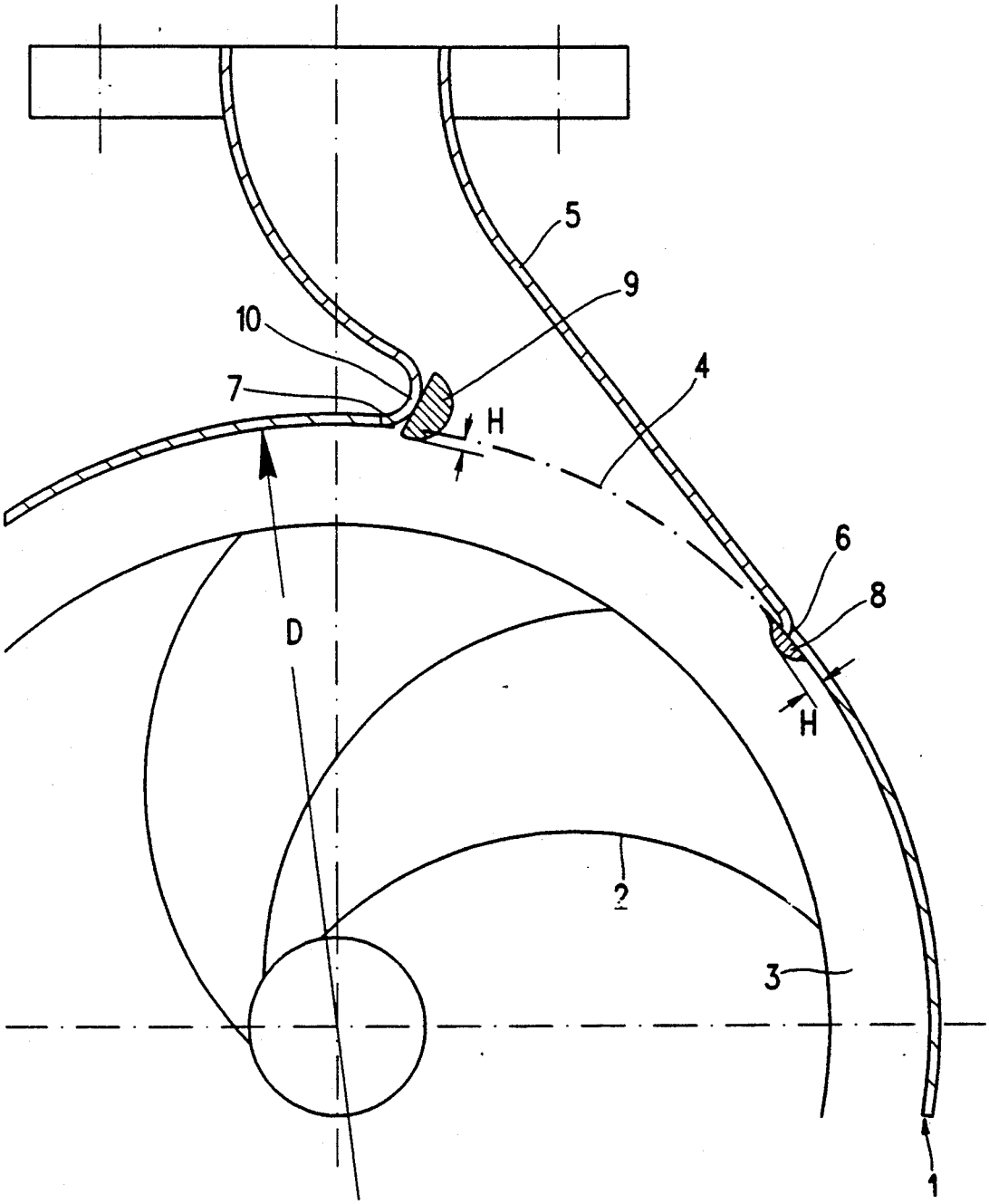
FIG. 1 shows a first embodiment of the invention.
Figure 2:
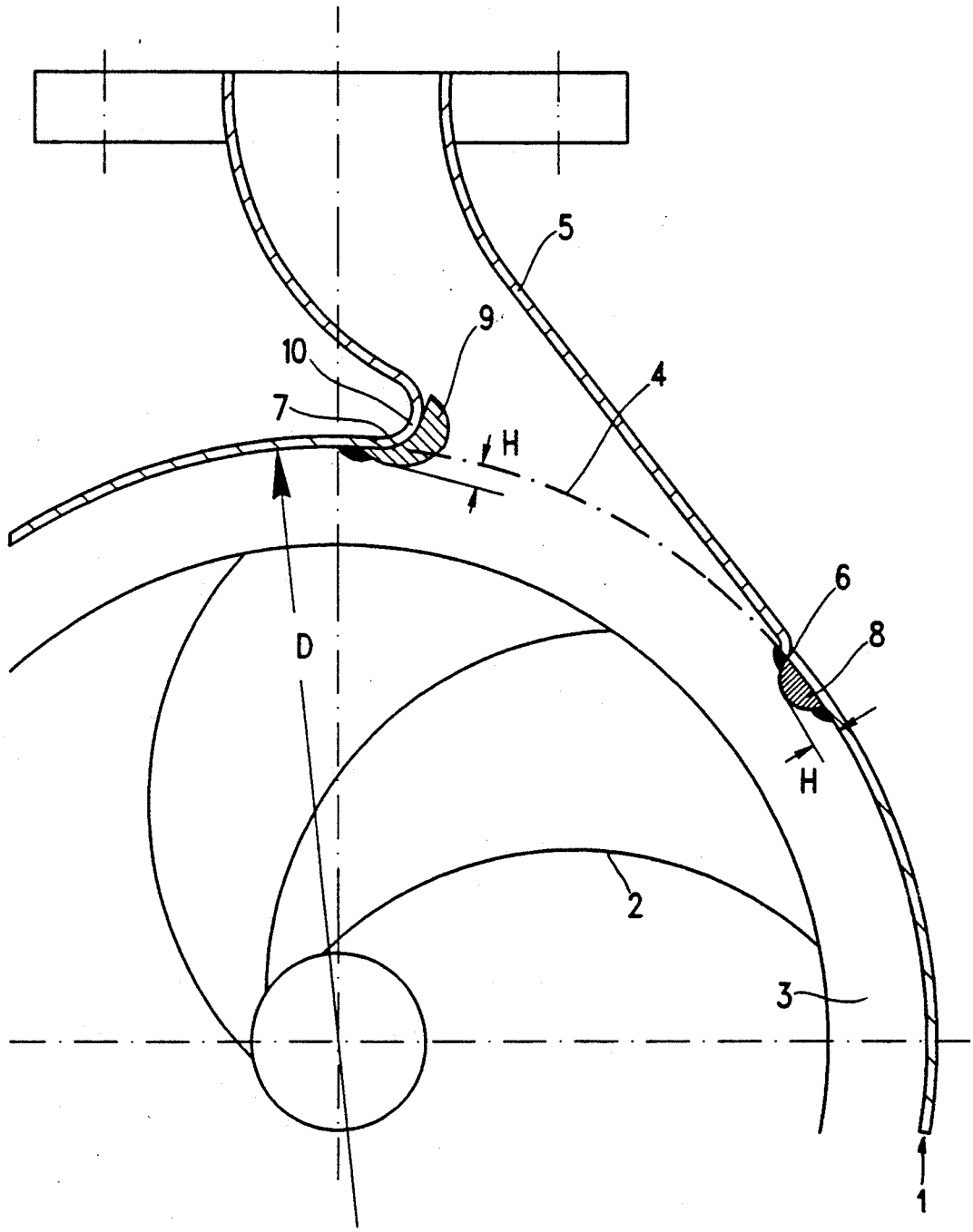
FIG. 2 shows a second embodiment of the invention.
Figure 3:
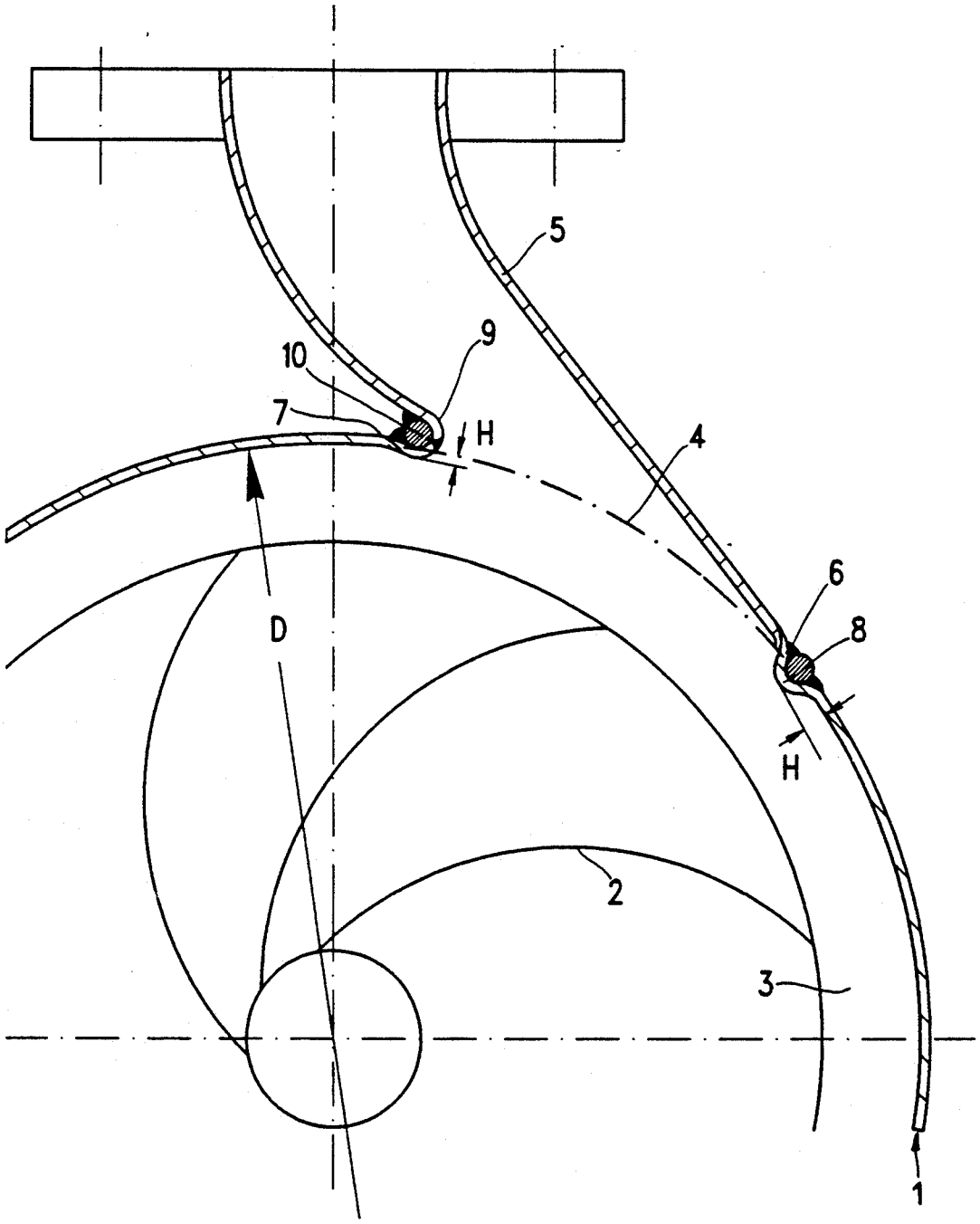
FIG. 3 shows a third embodiment of the invention.

An exemplary embodiment of the invention is illustrated in the drawing.

An impeller 2 is located inside a pump casing 1 made of sheet metal. An annular chamber 3 is formed between the impeller and the periphery of the pump casing. The pumped medium issuing from the impeller circulates in this annular chamber and leaves &he annular chamber 3 through an outlet opening 4 situated at the periphery of the pump casing to subsequently enter a discharge branch 5. By means of the latter, the pump casing is connected with a pipe system.

Shielding elements in the form of projections 8,9 running transverse to the flow direction are arranged at the leading edge 6 and trailing edge 7, as considered in the flow direction, of the outlet opening 4. These prevent abrasive particles in the pumped medium from destroying the outlet opening 4 and the following discharge branch 5 upon exiting the annular chamber. The order of magnitude of the solids content here corresponds to those values which pump manufacturers normally permit for clean water pumps.

In the illustrated example, the projection 9 has a design such that it extends into the outlet opening 4 and the discharge branch 5 attached thereto. Thus, the so-called casing spine 10 is protected from a direct attack by the abrasive constituents. The height H of the projections is measured from the inner diameter D of the casing 1. The smaller the height of the projections 8,9, the less significant is their influence on the pump efficiency.

I claim:

1. A pump comprising a casing having a peripheral wall and defining a chamber; and a rotor in said chamber for conveying fluid circumferentially along said wall in a rotational direction of an impeller, said wall being provided with an outlet opening for the fluid, and said opening having an upstream side and a downstream side, said sides extending transversely of said direction, and said opening being flanked by at least two shielding elements which extend into said chamber transversely of said direction in the region of said sides.

2. The pump of claim 1, wherein said rotor and said peripheral wall define an angular gap in said chamber, said gap having an outer periphery, and said opening being located at said outer periphery, said shielding elements extending into said gap.

3. The pump of claim 1, wherein said casing comprises sheet metal.

4. The pump of claim 1, wherein said rotor has a first length and at least one of said shielding elements has a second length substantially equal to said first length, said one shielding element being essentially coextensive with said rotor.

5. The pump of claim 1, wherein at least one of said shielding elements is constituted by an insert which is mounted in said casing.

6. The pump of claim 1, wherein at least one of said shielding elements is constituted by an embossment in said casing.

7. The pump of claim 6, further comprising a lining on said embossment externally of said casing.

8. The pump of claim 1, wherein at least one of said shielding elements extends into said chamber by a predetermined distance, said chamber having a predetermined diameter, and the ratio of said distance to said diameter being at most about 0.04.

9. The pump of claim 8, wherein said ratio is at least about 0.01.

10. The pump of claim 1, further comprising a discharge conduit which leads away from said opening, one of said shielding elements being located in the region of said downstream side, and said one shielding element protruding into both said opening and said conduit.

* * * * *